US009702030B2

(12) United States Patent
Takaku et al.

(10) Patent No.: US 9,702,030 B2
(45) Date of Patent: Jul. 11, 2017

(54) PRECIPITATION HARDENING TYPE MARTENSITIC STAINLESS STEEL, ROTOR BLADE OF STEAM TURBINE AND STEAM TURBINE

(71) Applicant: Kabushiki Kaisha Toshiba, Minato-ku (JP)

(72) Inventors: Reki Takaku, Yokohama (JP); Haruki Ohnishi, Yokohama (JP); Masayuki Yamada, Yokohama (JP); Yoriharu Murata, Yokohama (JP); Kenichi Imai, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 170 days.

(21) Appl. No.: 13/930,244

(22) Filed: Jun. 28, 2013

(65) Prior Publication Data

US 2014/0007981 A1 Jan. 9, 2014

(30) Foreign Application Priority Data

Jul. 3, 2012 (JP) ..... 2012-149654

(51) Int. Cl.

| | |
|---|---|
| ***C22C 38/44*** | (2006.01) |
| ***C22C 38/42*** | (2006.01) |
| ***C22C 38/50*** | (2006.01) |
| ***C22C 38/48*** | (2006.01) |
| ***C21D 6/00*** | (2006.01) |

(Continued)

(52) U.S. Cl.

CPC ..... *C22C 38/50* (2013.01); *C21D 1/25* (2013.01); *C21D 6/004* (2013.01); *C21D 6/02* (2013.01); *C22C 1/02* (2013.01); *C22C 38/22* (2013.01); *C22C 38/42* (2013.01); *C22C 38/44* (2013.01); *C22C 38/48* (2013.01); *C21D 2211/008* (2013.01)

(58) Field of Classification Search

None

See application file for complete search history.

(56) References Cited

U.S. PATENT DOCUMENTS 5,512,237 A * 4/1996 Stigenberg ..... 420/49
5,681,528 A 10/1997 Martin et al.

(Continued)

FOREIGN PATENT DOCUMENTS

DE 102 51 413 B3 3/2004
EP 0 859 869 B1 1/2000

(Continued)

OTHER PUBLICATIONS

Machine-English translation of Japanese patent No. 06-158228 to Moriya Yutaka et al., Jun. 7, 1994.*

(Continued)

*Primary Examiner* — Deborah Yee

(74) *Attorney, Agent, or Firm* — Oblon, McClelland, Maier & Neustadt, L.L.P.

(57) ABSTRACT

A precipitation hardening type martensitic stainless steel of an embodiment contains: Cr: 8.5 to 12.5%; Mo: 1 to 2%; Ni: 8.5 to 11.5%; Ti: 0.6 to 1.4%; C: 0.0005 to 0.05%; Al: 0.0005 to 0.25%; Cu: 0.005 to 0.75%; Nb: 0.0005 to 0.3%; Si: 0.005 to 0.75%; Mn: 0.005 to 1%; and N: 0.0001 to 0.03% by mass, and the balance of Fe and unavoidable impurities.

11 Claims, 2 Drawing Sheets

(51) Int. Cl.

| | |
|---|---|
| ***C22C 38/22*** | (2006.01) |
| ***C21D 6/02*** | (2006.01) |
| ***C21D 1/25*** | (2006.01) |
| ***C22C 1/02*** | (2006.01) |

(56) References Cited

U.S. PATENT DOCUMENTS

| | | | | |
|---|---|---|---|---|
| 5,855,844 | A | 1/1999 | Martin | |
| 2002/0160852 | A1 | 10/2002 | Chen | |
| 2006/0118215 | A1* | 6/2006 | Hirakawa | C21D 6/004 148/607 |
| 2009/0283138 | A1 | 11/2009 | Lin et al. | |

FOREIGN PATENT DOCUMENTS

| | | | |
|---|---|---|---|
| EP | 1 003 922 | B1 | 6/2004 |
| GB | 2 423 090 | A | 8/2006 |
| JP | 64-25952 | A | 1/1989 |
| JP | 6-158228 | | 6/1994 |
| JP | 3227468 | | 9/2001 |
| JP | 2005-194626 | A | 7/2005 |
| JP | 3962743 | | 5/2007 |
| JP | 4685028 | | 2/2011 |
| WO | WO 2005/078149 | A1 | 8/2005 |

OTHER PUBLICATIONS

J. Dothett, Heat Treating of Stainless sTeels, Heat Treating, vol. 4, ASM Handbook, ASM International, 1991, pp. 1-12, http// products,ASMinternational.org.*

Table 1.1 entited "Essential and incidental elements in steel and cast iron" p. 3, Introduction to Steels and Cast Irons, p. 3, ASM, 1989.*

"Corrosion Center News", Japan Society of Corrosion Engineering, No. 048, Jan. 2009, 36 pages.

The Extended European Search Report issued May 30, 2014, in Application No. / Patent No. 13174667.9-1353 / 2682484.

Office Action mailed Nov. 17, 2015, Japanese Patent Application No. 2012-149654, filed Nov. 6, 2015, (with English-language Translation).

Chinese Office Action issued Jun. 12, 2015, in corresponding Chinese Patent Application No. 201310276087.0 (with English-language Translation).

* cited by examiner

PRECIPITATION HARDENING TYPE MARTENSITIC STAINLESS STEEL, ROTOR BLADE OF STEAM TURBINE AND STEAM TURBINE

CROSS REFERENCE TO RELATED APPLICATION

This application is based upon and claims the benefit of priority from the prior Japanese Patent Application No. 2012-149654, filed on Jul. 3, 2012; the entire contents of which are incorporated herein by reference.

FIELD

Embodiments described herein relate generally to a precipitation hardening type martensitic stainless steel, a rotor blade of a steam turbine, and a steam turbine.

BACKGROUND

In a steam turbine for power generation, a rotor blade installed in a turbine stage of a low-pressure stage is apt to have a blade of an increased length for the sake of improvement of a power generation efficiency and an increase in a power generation capacity. Thus, a high strength, a high toughness, and a high corrosion resistance are required of a rotor blade installed in a turbine stage of a low-pressure stage.

As a material constituting a rotor blade of a low-pressure stage in an existing steam turbine, there is used a ferrous material having a property of a tensile strength of 1300 MPa class as a strength and a Charpy absorbed energy at a room temperature of 40 J class as a toughness. As the ferrous material constituting a rotor blade, one which is more excellent in a strength and a toughness is presently required.

Since a centrifugal stress by a high-speed rotation of a turbine acts on a rotor blade, as for the strength, a specific strength (obtained by dividing a tensile strength by a density) is given a greater importance. Thus, a titanium alloy or the like, which has a small density, is recently used as a material constituting a rotor blade. However, the titanium alloy is expensive and it is desired to substitute an inexpensive ferrous material for the titanium alloy.

As a ferrous material having a high strength, a high toughness, and a high corrosion resistance, there is cited a precipitation hardening type martensitic stainless steel. Study is being done for improving a strength, a toughness, a corrosion resistance and so on of this stainless steel.

In a conventional precipitation hardening type martensitic stainless steel, in general, a toughness is reduced when a tensile strength is improved. Therefore, various elements are added in order to improve the strength and the toughness in a balanced manner. However, a martensitic transformation start temperature is lowered when an amount of the added elements is large, making a retained austenite generated easily at a time of quenching. If an added amount of Cr is increased for the sake of improvement of a corrosion resistance, an δ ferrite is apt to be generated.

As described above, a complicated constraint condition exists for maintaining a stability of a martensite structure in a heat treatment process. A precipitation hardening type martensitic stainless steel having a predetermined strength and toughness is required under such a constraint.

In the conventional precipitation hardening type martensitic stainless steel, a sub-zero treatment is sometimes required in order to complete martensitic transformation in a heat treatment process, for example. There is a problem that a manufacturing cost increases by such a treatment. Further, in the conventional precipitation hardening type martensitic stainless steel, a sufficient strength or toughness suitable as a material for a rotor blade of a low-pressure stage in a steam turbine, for example, is not obtained.

DETAILED DESCRIPTION

Figure 1:
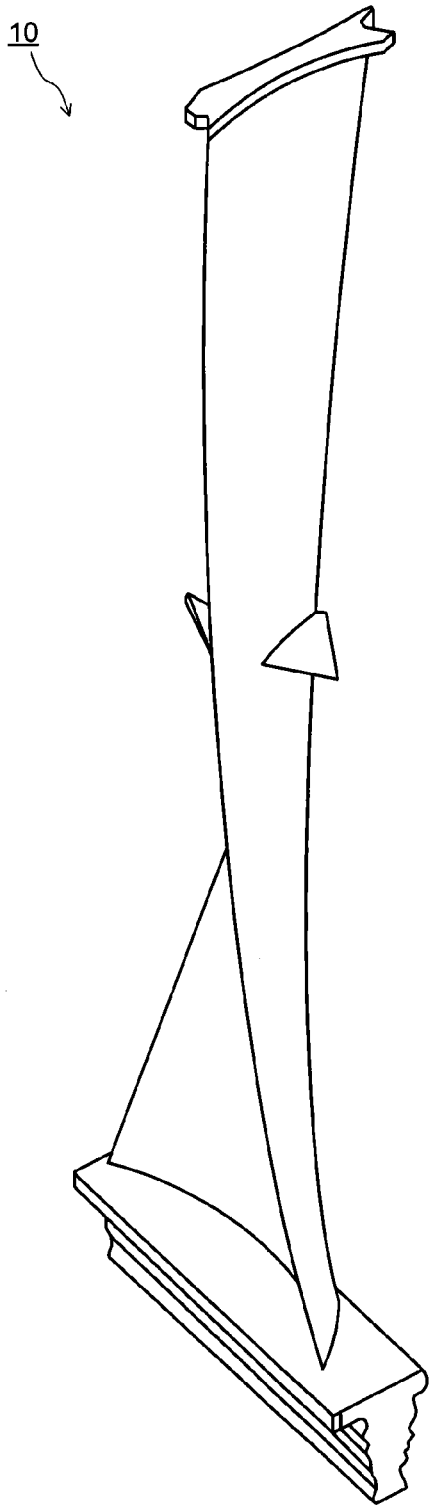
FIG. 1 is a perspective view of a rotor blade constituted by using a precipitation hardening type martensitic stainless steel of an embodiment.

Hereinafter, an embodiment of the present invention will be described.

A precipitation hardening type martensitic stainless steel according to an embodiment contains: Cr: 8.5 to 12.5%; Mo: 1 to 2%; Ni: 8.5 to 11.5%; Ti: 0.6 to 1.4%; C: 0.0005 to 0.05%; Al: 0.0005 to 0.25%; Cu: 0.005 to 0.75%; Nb: 0.0005 to 0.3%; Si: 0.005 to 0.75%; Mn: 0.005 to 1%; N: 0.0001 to 0.03% by mass, and the balance of Fe and an unavoidable impurities.

Here, as the unavoidable impurities, P, S, As, Sn, Sb, and so on, for example, are cited.

It is preferable that the precipitation hardening type martensitic stainless steel in the embodiment is constituted so that a value calculated from the following formula (1) becomes equal to or more than 0.1.

$$[Cr]/([Cr]+[Fe]) \qquad \text{formula (1)}$$

Here, each bracket in the formula (1) means a content ratio (mass %) of the element in each bracket (hereinafter, the same applies to a formula (2) and a formula (3)).

In order for a stainless steel to have a corrosion resistance (uniform corrosion resistance), it is necessary that a passive film is formed on a surface. Here, the larger a content ratio of Cr contained in the passive film is, the more excellent the corrosion resistance (uniform corrosion resistance) is. In other words, the larger the value of the formula (1) is, the more excellent the corrosion resistance (uniform corrosion resistance) is (for example, Japan Society of Corrosion Engineering, *Corrosion Center News*, No. 048, issued by Corrosion Center, January 2009).

In the precipitation hardening type martensitic stainless steel in the embodiment, the value of the formula (1) is adjusted to be equal to or more than 0.1 in order to improve the corrosion resistance (uniform corrosion resistance). Further, it is more preferable that the value of the formula (1) is adjusted to be equal to or more than 0.11. Note that an upper limit value of the value of the formula (1) is necessarily determined by a range of content ratios of Cr and Fe contained in the precipitation hardening type martensitic stainless steel in the embodiment.

It is preferable that the precipitation hardening type martensitic stainless steel in the embodiment is constituted so that a value calculated by the following formula (2) becomes equal to or more than 12.5.

$$[Cr]+3.3[Mo] \qquad \text{formula (2)}$$

A corrosion phenomenon called as a pitting generated by destruction of a passive film sometimes occurs in a stainless steel depending on an environment where the stainless steel is used. A pitting resistance of the stainless steel can be evaluated by a pitting resistance equivalent (PRE) represented by the formula (2) (for example, Japan Society of Corrosion Engineering, *Corrosion Center News*, No. 048, issued by Corrosion Center, January 2009).

In the precipitation hardening type martensitic stainless steel in the embodiment, the value of the formula (2) is adjusted to be equal to or more than 12.5 in order to improve the pitting resistance. Further, it is more preferable that the value of the formula (2) is adjusted to be equal to or more than 14. Note that an upper limit value of the value of the formula (2) is necessarily determined by a range of content ratios of Cr and Mo contained in the precipitation hardening type martensitic stainless steel in the embodiment.

It is preferable that the precipitation hardening type martensitic stainless steel in the embodiment fulfills at least either one of conditions according to the above-described formula (1) and formula (2), and it is more preferable that the precipitation hardening type martensitic stainless steel in the embodiment fulfils both the conditions. As a result of using the precipitation hardening type martensitic stainless steel which fulfills at least either one of the conditions according to the above-described formula (1) and formula (2) to constitute a rotor blade to be installed in a turbine stage of a low-pressure stage of a steam turbine, for example, it becomes possible to obtain a rotor blade more excellent in a corrosion resistance.

It is preferable that the precipitation hardening type martensitic stainless steel in the embodiment is constituted so that a value calculated from the following formula (3) becomes equal to or more than 100.

$$195-1200([C]-0.006)-23([Cr]-12)-40([Ni]-9)-16([Mo]+0.5[W]-1.5)-3.75[Al]-34[Ti]-20[Cu] \quad \text{formula (3)}$$

In the formula (3), a tungsten (W), which is not contained in a composition of the precipitation hardening type martensitic stainless steel in the embodiment is listed, and a content ratio of W is substituted when W is contained in the unavoidable impurities, for example. Therefore, when W is not contained, a value of [W] is [0].

A heat treatment performed in a process of fabricating a turbine part such as a rotor blade, for example, from the precipitation hardening type martensitic stainless steel influences a manufacturing cost and so on. Thus, an action of an alloying element on the martensite transformation start temperature is also considered to be important in a martensitic stainless steel. The formula (3) is an index used as an evaluation index Ms (° C.) of a martensitic transformation start temperature in a precipitation hardening type martensitic stainless steel.

In the precipitation hardening type martensitic stainless steel in the embodiment, it is preferable that the value of the formula (3), that is, a value of Ms, is equal to or more than 100 in order for a complete quenched martensite structure after quenching.

When the evaluation index Ms of the martensitic transformation start temperature, being the value of the formula (3), is equal to or more than 100, most part of the structure can be made a martensite also by common cooling. Thus, a low-temperature treatment such as a sub-zero treatment becomes unnecessary. It is more preferable that the value of the formula (3) is equal to or more than 120 in order that a center portion of a thick-walled material, in which cooling speed is slow, or most part including a micro segregation portion in which a chemical component is segregated is made a martensite. Note that an upper limit value of the value of the formula (3) is necessarily determined by a range of a content ratio of each component included in the formula (3), each component being contained in the precipitation hardening type martensitic stainless steel in the embodiment.

Here, it is preferable that the precipitation hardening type martensitic stainless steel in the embodiment fulfills at least either one of conditions according to the above-described formula (1) and formula (2) and fulfills a condition according to the formula (3). Further, it is more preferable that the precipitation hardening type martensitic stainless steel in the embodiment fulfils all the conditions according to the above-described formula (1) to formula (3).

A reason for limitation of the range of each component in the above-described precipitation hardening type martensitic stainless steel of the embodiment will be explained. Note that "%" indicating the component in the following explanation means mass % as long as not mentioned in particular.

(1) Cr (Chromium)

Cr is an important element for obtaining an excellent corrosion resistance. In order to exert its effect, Cr is necessary to be contained by equal to or more than 8.5%. On the other hand, when a content ratio of Cr exceeds 12.5%, a toughness is reduced due to precipitation of a δ ferrite. Further, addition of another element effective for improvement of a strength or a toughness is limited. Thus, the content ratio of Cr is adjusted to be 8.5 to 12.5%. For a similar reason, it is more preferable that the content ratio of Cr is adjusted to be 9 to 10%.

(2) Mo (Molybdenum)

Mo, similar to Cr, is an element effective for improvement of a corrosion resistance. In order to exert its effect, Mo is necessary to be contained by equal to or more than 1%. On the other hand, when a content ratio of Mo exceeds 2%, a toughness is reduced due to precipitation of a δ ferrite. Further, since Mo is a comparatively expensive element, a manufacturing cost is increased. Thus, the content ratio of Mo is adjusted to be 1 to 2%. For a similar reason, it is more preferable that the content ratio of Mo is adjusted to be 1.3 to 1.8%.

(3) Ni (Nickel)

Ni forms an intermetallic compound with Ti and contributes to precipitation hardening, improves a toughness, and has an effect of suppressing precipitation of a δ ferrite. In order to attain a targeted toughness, Ni is necessary to be contained by equal to or more than 8.5%. On the other hand, when a content ratio of Ni exceeds 11.5%, the evaluation index Ms represented by the aforementioned formula (3) is reduced and a retained austenite is generated. Further, since Ni is a comparatively expensive element, a manufacturing cost is increased. Thus, the content ratio of Ni is adjusted to be 8.5 to 11.5%. For a similar reason, it is more preferable that the content ratio of Ni is adjusted to be 10 to 11.5%.

(4) Ti (Titanium)

Ti forms an intermetallic compound with Ni and contributes to precipitation hardening. In order to exert its effect, Ti is necessary to be contained by equal to or more than 0.6%. On the other hand, when a content ratio of Ti exceeds 1.4%, a toughness is reduced. Thus, the content ratio of Ti is adjusted to be 0.6 to 1.4%. For a similar reason, it is more preferable that the content ratio of Ti is adjusted to be 0.7 to 1.3%.

(5) C (Carbon)

C is effective for suppression of precipitation of a δ ferrite. In order to exert its effect, C is necessary to be contained by equal to or more than 0.0005%. On the other hand, when a content ratio of C exceeds 0.05%, the evaluation index Ms represented by the aforementioned formula (3) is reduced, and a retained austenite is generated. Further, precipitation of a carbide reduces a corrosion resistance. Thus, a content ratio of C is adjusted to be 0.0005 to 0.05%. For a similar reason, it is more preferable that the content ratio of C is adjusted to be 0.01 to 0.02%.

(6) Al (Aluminum)

Al contributes to precipitation hardening. In order to exert its effect, Al is necessary to be contained by equal to or more than 0.0005%. On the other hand, when a content ratio of Al exceeds 0.25%, a toughness is reduced. Thus, the content ratio of Al is adjusted to be 0.0005 to 0.25%. For a similar reason, it is more preferable that the content ratio of Al is adjusted to be 0.001 to 0.025%.

(7) Cu (Copper)

Cu contributes to precipitation hardening. In order to exert its effect, Cu is necessary to be contained by equal to or more than 0.005%. On the other hand, when a content ratio of Cu exceeds 0.75%, a toughness, a ductility, and a strength are reduced. Thus, the content ratio of Cu is adjusted to be 0.005 to 0.75%. For a similar reason, it is more preferable that the content ratio of Cu is adjusted to be 0.005 to 0.25%.

(8) Nb (Niobium)

Nb contributes to precipitation hardening. In order to exert its effect, Nb is necessary to be contained by equal to or more than 0.0005%. On the other hand, when a content ratio of Nb exceeds 0.3%, a toughness is reduced. Thus, the content ratio of Nb is adjusted to be 0.0005 to 0.3%. For a similar reason, it is more preferable that the content ratio of Nb is adjusted to be 0.001 to 0.025%.

(9) Si (Silicon)

Si has a function as a deoxidizer. In order to exert its effect, Si is necessary to be contained by equal to or more than 0.005%. On the other hand, when a content ratio of Si exceeds 0.75%, a toughness is reduced due to precipitation of a δ ferrite. Thus, the content ratio of Si is adjusted to be 0.005 to 0.75%. For a similar reason, it is preferable that the content ratio of Si is adjusted to be 0.005 to 0.1%.

(10) Mn (Manganese)

Mn has an effect as a deoxidizer, and is effective for suppressing precipitation of a δ ferrite. In order to exert its effect, Mn is necessary to be contained by equal to or more than 0.005%. On the other hand, when a content ratio of Mn exceeds 1%, a retained austenite is generated. Thus, the content ratio of Mn is adjusted to be 0.005 to 1%. For a similar reason, it is preferable that the content ratio of Mn is adjusted to be 0.005 to 0.1%.

(11) N (Nitrogen)

N is effective for suppressing precipitation of a δ ferrite. In order to exert its effect, N is necessary to be contained by equal to or more than 0.0001%. On the other hand, when a content ratio of N exceeds 0.03%, a retained austenite is generated. Further, N forms a compound with Ti, and formation of an intermetallic compound of Ni and Ti, which contributes to a strength, is suppressed. Thus, the content ratio of N is adjusted to be 0.0001 to 0.03%. For a similar reason, it is preferable that the content ratio of N is adjusted to be 0.0005 to 0.01%.

(12) P (Phosphor), S (Sulfur), as (Arsenic), Sn (Tin) and Sb (Antimony)

In the precipitation hardening type martensitic stainless steel of the embodiment, P, S, As, Sn, and Sb are components classified into unavoidable impurities. It is desirable that residual content ratios of those unavoidable impurities are made to approach 0% as far as possible.

The above-described precipitation hardening type martensitic stainless steel of the embodiment is excellent in a strength and a toughness. Thus, the precipitation hardening type martensitic stainless steel of the embodiment is suitable as a material to constitute a rotor blade of a steam turbine, for example. The precipitation hardening type martensitic stainless steel of the embodiment is suitable as a material to constitute a rotor blade installed in a low-pressure stage (for example, final stage) of a low-pressure turbine, of which rotor blade a high strength, a high toughness and a high corrosion resistance in particular are required, a blade length being increased for example, among the rotor blades of the steam turbine.

Here, there will be described a method for manufacturing the precipitation hardening type martensitic stainless steel of the embodiment and a rotor blade of a steam turbine manufactured by using the precipitation hardening type martensitic stainless steel.

The precipitation hardening type martensitic stainless steel of the embodiment is manufactured as below, for example.

Raw materials necessary for obtaining a composition constituting the above-described precipitation hardening type martensitic stainless steel are melted in a melting furnace such as an arc type electric furnace and a vacuum induction electric furnace, and refining and degassing are performed. Then, the raw materials are poured into a mold of a predetermined size and solidified, so that a steel ingot is formed. Here, if a heterogeneous constitution such as a segregation occurs in the steel ingot, it is preferable to melt the steel ingot again by ESR (electroslag remelting), VAR (vacuum arc remelting) or the like in order to have a homogeneous constitution. It is preferable that the raw materials having been remelted are then poured into the mold of the predetermined size and solidified to form a steel ingot.

Subsequently, the steel ingot having completed solidification is heated to 1050 to 1250° C. and performed to hot working (casting) to have a predetermined size. Subsequently, a solution treatment is performed to the steel ingot at a temperature of 940 to 980° C. for a predetermined time, and thereafter, water quenching is performed. Subsequently, an aging treatment is performed to the steel ingot at a temperature of 490 to 580° C. for a predetermined time. By performing the aging treatment, strengthening of precipitation by an intermetallic compound or a carbide can be done. After passing through the above process, the precipitation hardening type martensitic stainless steel is manufactured.

The rotor blade of the steam turbine is manufactured as below, for example.

Raw materials necessary for obtaining a composition constituting the above-described precipitation hardening type martensitic stainless steel are melted in a melting furnace such as an arc type electric furnace and a vacuum induction electric furnace, and refining and degassing are performed. Then, the raw materials are poured into a mold of a predetermined size and solidified, so that a steel ingot is formed. Here, if a heterogeneous constitution such as a segregation occurs in the steel ingot, it is preferable to melt the steel ingot again by ESR (electroslag remelting), VAR (vacuum arc remelting) or the like in order to have a homogeneous constitution. It is preferable that the raw materials having been remelted are then poured into the mold of the predetermined size and solidified to form a steel ingot.

Subsequently, the steel ingot having completed solidification is heated to 1050 to 1250° C., and performed to hot working (mold casting) into a blade shape of the rotor blade by using a mold. Subsequently, a solution treatment is performed to the steel ingot at a temperature of 940 to 980° C. for a predetermined time, and thereafter, water quenching is performed. Subsequently, an aging treatment is performed to the steel ingot at a temperature of 490 to 580° C. for a predetermined time. By performing the aging treatment, strengthening of precipitation by an intermetallic compound or a carbide can be done. After passing through the above process, the rotor blade is manufactured.

Here, the above-described ranges are preferable as heating temperatures in the solution treatment and the aging treatment for the following reasons. In the solution treatment, when the temperature is lower than 940° C., solid-solving of a coarse solid-unsolved carbonitride generated at a time of hot working is insufficient. In the solution treatment, when the temperature is higher than 980° C., an austenite crystal grain diameter is coarse, and a toughness after the aging treatment is reduced. In the aging treatment, when the temperature is lower than 490° C., age-precipitation of an intermetallic compound is not done sufficiently, and improvement of a strength is not sufficient. In the aging treatment, when the temperature is higher than 580° C., the intermetallic compound is age-precipitated excessively, and a toughness is reduced.

Figure 2:
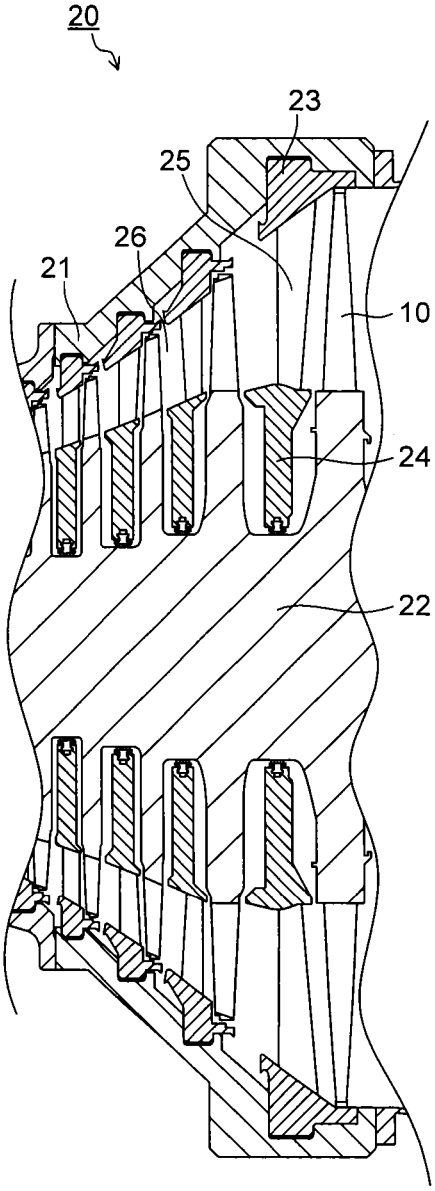
FIG. 2 is a diagram showing a part of a meridian cross section of a steam turbine having the rotor blade constituted by using the precipitation hardening type martensitic stainless steel of the embodiment.

FIG. 1 is a perspective view of a rotor blade 10 constituted by using the precipitation hardening type martensitic stainless steel of the embodiment. FIG. 2 is a view showing a part of a meridian cross section of a steam turbine 20 having the rotor blade 10 constituted by using the precipitation hardening type martensitic stainless steel of the embodiment.

After the above-described manufacturing process, the rotor blade 10 of a long blade shown in FIG. 1, for example, is manufactured. The rotor blade 10 is installed in a turbine stage of a final stage of a low-pressure turbine, for example.

The steam turbine 20 has a casing 21, and in the casing 21, a turbine rotor 22 in which the rotor blade 10 is implanted is penetratingly provided. A plurality of the rotor blades 10 is implanted in a circumferential direction to constitute a rotor blade cascade, and a plurality of the rotor blade cascades is provided in a turbine rotor shaft direction. The turbine rotor 22 is supported by a not-shown rotor bearing in a rotatable manner.

In an inner periphery of the casing 21, a stationary blade 25 supported by a diaphragm outer ring 23 and a diaphragm inner ring 24 is disposed in a manner to be alternated with the rotor blade 10 in a shaft direction of the turbine rotor 22. A plurality of the stationary blades 25 is disposed in a circumferential direction to constitute a stationary blade cascade. The stationary blade cascade and the rotor blade cascade of directly downstream of the stationary blade cascade constitute one turbine stage.

Steam having flown into the steam turbine 20 passes, while performing enlarging work, through a steam passage 26 which has the stationary blade 25 and the rotor blade 10 of each turbine stage and gradually enlarges, and make the turbine rotor 22 rotate. Then, the steam having passed through the turbine stage of the final stage passes through a discharge passage (not shown) and flows out of the steam turbine 20.

As described above, by constituting the rotation blade 10 of the steam turbine 20 by the precipitation hardening type martensitic stainless steel of the embodiment, it is possible to constitute a rotation blade 10 excellent in a strength and a toughness.

(Evaluation of Strength and Toughness)

(Influence of Chemical Composition)

Hereinafter, it will be explained that the precipitation hardening type martensitic stainless steel of the embodiment is excellent in a strength and a toughness. First, an influence of the chemical composition exerted on the strength and the toughness will be described.

Table 1 shows chemical compositions of a sample 1 to a sample 13 used for evaluation of the strength and the toughness. Table 2 shows heat treatment conditions and evaluation results of the strength and the toughness. Note that the sample 1 to the sample 8 are precipitation hardening type martensitic stainless steel within a range of the chemical composition of the present embodiment. The sample 9 to the sample 13 are precipitation hardening type martensitic stainless steel whose compositions are not in the range of the chemical composition of the present embodiment, and are comparative examples. The composition of each sample shown in Table 1 is indicated by mass %. Further, Table 1 shows values calculated from the aforementioned formula (1), formula (2) and formula (3). A value Ms shown in Table 1 is a value calculated from the formula (3).

TABLE 1

| | Cr | Mo | Ni | Ti | C | Al | Cu | Nb | Si | Mn | N | Fe | [Cr]/([Cr] + [Fe]) | [Cr] + 3.3[Mo], mass % | Ms, ° C. |
|---|---|---|---|---|---|---|---|---|---|---|---|---|---|---|---|
| Sample 1 | 9.46 | 1.51 | 11.07 | 1.17 | 0.001 | 0.0045 | 0.009 | 0.0017 | 0.008 | 0.008 | 0.0009 | Bal. | 0.11 | 14.4 | 136.0 |
| Sample 2 | 9.52 | 1.51 | 11.04 | 0.85 | 0.001 | 0.0045 | 0.009 | 0.0019 | 0.009 | 0.009 | 0.0009 | Bal. | 0.11 | 14.5 | 147.4 |
| Sample 3 | 9.52 | 1.47 | 10.98 | 1.36 | 0.001 | 0.0042 | 0.008 | 0.0019 | 0.009 | 0.008 | 0.0008 | Bal. | 0.11 | 14.4 | 133.1 |
| Sample 4 | 9.46 | 1.46 | 11.03 | 1.16 | 0.014 | 0.01 | 0.13 | 0.011 | 0.02 | 0.01 | 0.01 | Bal | 0.11 | 14.3 | 121.2 |
| Sample 5 | 12.04 | 1.48 | 9.02 | 1.37 | 0.001 | 0.0047 | 0.009 | 0.0018 | 0.009 | 0.009 | 0.0011 | Bal. | 0.14 | 16.9 | 153.0 |
| Sample 6 | 12.07 | 1.50 | 8.97 | 1.20 | 0.001 | 0.0049 | 0.009 | 0.0018 | 0.009 | 0.007 | 0.0007 | Bal. | 0.14 | 17.0 | 159.8 |
| Sample 7 | 11.92 | 1.49 | 9.50 | 0.81 | 0.001 | 0.0043 | 0.009 | 0.0019 | 0.008 | 0.007 | 0.0008 | Bal. | 0.14 | 16.8 | 155.5 |
| Sample 8 | 11.56 | 1.32 | 10.83 | 0.94 | 0.001 | 0.0045 | 0.008 | 0.0018 | 0.008 | 0.009 | 0.0008 | Bal. | 0.13 | 15.9 | 108.8 |
| Sample 9 | 9.51 | 1.52 | 11.10 | 1.60 | 0.001 | 0.0044 | 0.025 | 0.0018 | 0.007 | 0.008 | 0.0010 | Bal. | 0.11 | 14.1 | 119.6 |
| Sample 10 | 9.47 | 1.50 | 10.96 | 0.55 | 0.001 | 0.0045 | 0.031 | 0.0019 | 0.009 | 0.008 | 0.0010 | Bal. | 0.11 | 14.0 | 162.1 |
| Sample 11 | 12.03 | 1.48 | 8.06 | 1.21 | 0.001 | 0.0045 | 0.009 | 0.0019 | 0.009 | 0.009 | 0.0012 | Bal. | 0.13 | 16.5 | 197.1 |
| Sample 12 | 8.20 | 1.46 | 9.50 | 0.90 | 0.001 | 0.0045 | 0.008 | 0.0018 | 0.009 | 0.009 | 0.0010 | Bal. | 0.09 | 13.0 | 238.4 |
| Sample 13 | 12.70 | 1.45 | 10.82 | 0.91 | 0.001 | 0.0042 | 0.009 | 0.0019 | 0.009 | 0.008 | 0.0009 | Bal. | 0.15 | 17.5 | 82.0 |

Bal. = Balance

TABLE 2

| | Solution Treatment Condition | | Aging Treatment Condition | | | |
|---|---|---|---|---|---|---|
| | Temperature, ° C. | Time, hour | Temperature, ° C. | Time, hour | Tensile Strength, MPa | Charpy Absorbed Energy, J |
| Sample 1 | 950 | 1 | 545 | 4 | 1510 | 85.2 |
| Sample 2 | 950 | 1 | 510 | 4 | 1517 | 42.7 |
| Sample 3 | 950 | 1 | 555 | 4 | 1505 | 70.5 |
| Sample 4 | 950 | 1 | 545 | 4 | 1520 | 43.5 |
| Sample 5 | 950 | 1 | 545 | 4 | 1523 | 41.9 |
| Sample 6 | 950 | 1 | 545 | 4 | 1508 | 44.5 |
| Sample 7 | 950 | 1 | 545 | 4 | 1500 | 43.3 |
| Sample 8 | 950 | 1 | 530 | 4 | 1505 | 66.4 |
| Sample 9 | 950 | 1 | 555 | 4 | 1515 | 30.4 |

TABLE 2-continued

| | Solution Treatment Condition | | Aging Treatment Condition | | | |
|---|---|---|---|---|---|---|
| | Temperature, ° C. | Time, hour | Temperature, ° C. | Time, hour | Tensile Strength, MPa | Charpy Absorbed Energy, J |
| Sample 10 | 950 | 1 | 530 | 4 | 1524 | 29.8 |
| Sample 11 | 950 | 1 | 545 | 4 | 1510 | 32.0 |
| Sample 12 | 950 | 1 | 545 | 4 | 1505 | 25.1 |
| Sample 13 | 950 | 1 | 530 | 4 | 1518 | 26.9 |

Here, the strength was evaluated by a tensile test (tensile strength) and the toughness was evaluated by a Charpy impact test (Charpy absorbed energy). A test piece used in each test was fabricated as below.

Respective raw materials necessary for obtaining compositions constituting the precipitation hardening type martensitic stainless steels of sample 1 to sample 13 having chemical compositions shown in FIG. 1 were melted in a vacuum melting furnace, refined and degassed. Then, an ingot of 30 was fabricated.

Subsequently, the ingot having completed solidification was heated to 1100° C., and performed to hot working (casting) to be a flat board.

Subsequently, the solution treatment was performed to each flat plate under the solution condition shown in Table 2, and thereafter, water quenching was performed. The aging treatment was performed to each flat plate having been performed to the solution treatment under the aging treatment condition shown in Table 2. After the aging treatment, a test piece for a tensile test and a test piece for a Charpy impact test were taken from each flat plate, with a test piece longitudinal direction being regarded as an extend forging direction.

The tensile test was performed by using the test piece with a parallel part diameter of 6 mm and a parallel part length of 30 mm, at a room temperature in conformity with JIS Z 2241. The impact test was performed by using a full-size V-notch test piece and adjusting a shock blade radius to be 2 mm, at a room temperature in conformity with JIS Z 2242. In the tensile test and the Charpy impact test, the tests were performed to two test pieces and an average thereof was used as a test result.

As shown in Table 2, it is found that the sample 1 to the sample 8, the tensile strength being equal to or more than 1500 MPa and the Charpy absorbed energy exceeding 40 J, are excellent in both the strength and the toughness. The above results indicate that high strength and toughness are obtained compared with a material used for a rotor blade of a low-pressure stage in an existing steam turbine, the material having a tensile strength of 1300 MPa class (room temperature) and a Charpy absorbed energy f 40 J class (room temperature).

On the other hand, it is found that the sample 9 to the sample 13 according to the comparative examples, having a Charpy absorbed energy of less than 40 J, are inferior in the toughness.

(Influence of Heat Treatment Temperature)

Here, there will be described an effect of a heat treatment temperature in the solution treatment and the aging treatment on the strength and the toughness. Table 3 shows the solution treatment conditions, the aging treatment conditions, and evaluation results of the strength and the toughness.

TABLE 3

| | Solution Treatment Condition | | Aging Treatment Condition | | | |
|---|---|---|---|---|---|---|
| | Temperature, ° C. | Time, hour | Temperature, ° C. | Time, hour | Tensile Strength, MPa | Charpy Absorbed Energy, J |
| Sample 14 | 950 | 1 | 530 | 4 | 1543 | 74.8 |
| Sample 15 | 930 | 1 | 545 | 4 | 1510 | 28.6 |
| Sample 16 | 1000 | 1 | 545 | 4 | 1524 | 31.6 |
| Sample 17 | 950 | 1 | 480 | 4 | 1632 | 20.2 |
| Sample 18 | 950 | 1 | 600 | 4 | 1258 | 97.5 |

The influence of the heat treatment temperature was investigated through using the sample 1 shown in Table 1, by performing the solution treatment to a flat plate formed by way of melting in a vacuum melting furnace and hot working under each solution treatment condition shown in table 3 and thereafter performing water quenching, similarly to in the investigation of the influence of the chemical composition. The aging treatment was performed to each flat plate having been performed to the solution treatment under the aging treatment condition shown in Table 3. After the aging treatment, a test piece for a tensile test and a test piece for a Charpy impact test were taken from each flat plate, with a test piece longitudinal direction being regarded as an extend forging direction.

Similarly to in the investigation of the influence of the chemical composition, the strength was evaluated by a tensile test and the toughness was evaluated by a Charpy impact test.

As shown in Table 3, when a solution treatment temperature is 940 to 980° C. and an aging treatment temperature is 490 to 580° C. (sample 14), a tensile strength is equal to or more than 1500 MPa and a Charpy absorbed energy is equal to or more than 40 J, and it is found that the sample is excellent in both the strength and the toughness. Note that also in the sample 1 shown in Table 2, whose solution treatment temperature and aging treatment temperature are within the above-described ranges, a similar result to that of the sample 14 was obtained.

On the other hand, when the solution treatment temperature is not within the range of 940 to 980° C. or the aging treatment temperature is not within the range of 490 to 580° C. (sample 15 to sample 18), either one of the tensile strength and the Charpy absorbed energy is low, and one excellent in both the strength and the toughness does not exist.

According to the embodiment described hereinabove, it becomes possible to obtain excellent strength and toughness.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A precipitation hardening martensitic stainless steel containing:

Cr (chromium): 9 to 10%;

Mo (molybdenum): 1 to 2%;

Ni (nickel): 8.5 to 11.5%;

Ti (titanium): 0.9 to 1.4%;

C (carbon): 0.0005 to 0.05%;
Al (aluminum): 0.0005 to 0.25%;
Cu (copper): 0.005 to 0.25%;
Nb (niobium): 0.0017 to 0.0019%;
Si (silicon): 0.005 to 0.75%;
Mn (manganese): 0.005 to 1%; and
N (nitrogen): 0.0001 to 0.03% by mass,
and the balance of Fe (iron) and unavoidable impurities.

2. The precipitation hardening martensitic stainless steel according to claim 1, wherein a value calculated from formula (1) is equal to or more than 0.1:

$$[Cr]/([Cr]+[Fe]) \quad \text{formula (1)}$$

where each bracket in formula (1) means a content ratio in mass % of the element in each bracket.

3. The precipitation hardening martensitic stainless steel according to claim 1, wherein a value calculated from formula (2) is equal to or more than 12.5:

$$[Cr]+3.3[Mo] \quad \text{formula (2)}$$

where each bracket in formula (2) means a content ratio in mass % of the element in each bracket.

4. The precipitation hardening martensitic stainless steel according to claim 2, wherein a value calculated from formula (2) is equal to or more than 12.5:

$$[Cr]+3.3[Mo] \quad \text{formula (2)}$$

where each bracket in formula (2) means a content ratio in mass % of the element in each bracket.

5. The precipitation hardening martensitic stainless steel according to claim 1, wherein a value calculated from formula (3) is equal to or more than 100:

$$195-1200([C]-0.006)-23([Cr]-12)-40([Ni]-9)-16([Mo]+0.5[W]-1.5)-3.75[Al]-34[Ti]-20[Cu] \quad \text{formula (3)}$$

where each bracket in formula (3) means a content ratio in mass % of the element in each bracket.

6. The precipitation hardening martensitic stainless steel according to claim 2, wherein a value calculated from formula (3) is equal to or more than 100:

$$195-1200([C]-0.006)-23([Cr]-12)-40([Ni]-9)-16([Mo]+0.5[W]-1.5)-3.75[Al]-34[Ti]-20[Cu] \quad \text{formula (3)}$$

where each bracket in formula (3) means a content ratio in mass % of the element in each bracket.

7. The precipitation hardening martensitic stainless steel according to claim 3, wherein a value calculated from formula (3) is equal to or more than 100

$$195-1200([C]-0.006)-23([Cr]-12)-40([Ni]-9)-16([Mo]+0.5[W]-1.5)-3.75[Al]-34[Ti]-20[Cu] \quad \text{formula (3)}$$

where each bracket in formula (3) means a content ratio in mass % of the element in each bracket.

8. The precipitation hardening martensitic stainless steel according to claim 4, wherein a value calculated from formula (3) is equal to or more than 100

$$195-1200([C]-0.006)-23([Cr]-12)-40([Ni]-9)-16([Mo]+0.5[W]-1.5)-3.75[Al]-34[Ti]-20[Cu] \quad \text{formula (3)}$$

where each bracket in formula (3) means a content ratio in mass % of the element in each bracket.

9. The precipitation hardening martensitic stainless steel according to claim 1, wherein a solution treatment is performed at a temperature of 940 to 980° C. and an aging treatment is performed at a temperature of 490 to 580° C.

10. A rotor blade of a steam turbine, comprising the precipitation hardening martensitic stainless steel according to claim 1.

11. A steam turbine which has the rotor blade according to claim 10 in at least one turbine stage.

* * * * *